United States Patent [19]

Naya et al.

[11] Patent Number: 4,853,184

[45] Date of Patent: Aug. 1, 1989

[54] CONTACT MATERIAL FOR VACUUM INTERRUPTER

[75] Inventors: Eizo Naya; Yoshikazu Nagata; Toshiaki Horiuchi; Mitsuhiro Okumura; Michinosuke Demizu; Mitsuhiro Harima; Shigeki Asakawa; Masuo Asakawa, all of Amagasaki,

[73] Assignee: Mitsubishi Denki Kabushiki Kaisha, Tokyo, Japan

[21] Appl. No.: 797,324

[22] PCT Filed: Sep. 11, 1984

[86] PCT No.: PCT/JP84/00440

§ 371 Date: Dec. 16, 1985

§ 102(e) Date: Dec. 16, 1985

[87] PCT Pub. No.: WO85/03802

PCT Pub. Date: Aug. 29, 1985

[30] Foreign Application Priority Data

Feb. 16, 1984 [JP] Japan ..... 59-28194

[51] Int. Cl.[4] ..... C22C 9/00

[52] U.S. Cl. ..... 420/489; 420/490; 420/491; 420/494; 420/499; 420/500; 200/266

[58] Field of Search ..... 420/489, 490, 492, 495, 420/491, 494, 499, 500; 200/266

[56] References Cited

U.S. PATENT DOCUMENTS

| | | | |
|---|---|---|---|
| 3,615,899 | 10/1971 | Yokohama | 420/490 |
| 3,957,453 | 5/1976 | Hassler et al. | 428/567 |
| 4,008,081 | 2/1977 | Hundstad | 420/495 |
| 4,014,659 | 3/1977 | Hassler et al. | 29/182.5 |
| 4,517,033 | 5/1985 | Okumura et al. | 148/432 |
| 4,575,451 | 3/1986 | Naya et al. | 420/489 |

FOREIGN PATENT DOCUMENTS

| | | |
|---|---|---|
| 1016779 | 9/1977 | Canada . |
| 54-7944 | 4/1979 | Japan . |
| 167926 | 9/1984 | Japan . |
| 1421637 | 6/1973 | United Kingdom . |

*Primary Examiner*—Christopher W. Brody

*Attorney, Agent, or Firm*—Lowe, Price, Leblanc, Becker & Shur

[57] ABSTRACT

The invention relates to contact material for vacuum interrupter, and in order to be splendid in the breakdown voltage ability and increase the interrupting ability, a contact material is constituted by containing copper and chromium, and moreover adding one component selected from silicon, titanium, zirconium and aluminum as another component, and is used in a vacuum interrupter.

6 Claims, 13 Drawing Sheets

CONTACT MATERIAL FOR VACUUM INTERRUPTER

DESCRIPTION

1. Technical Field

The present invention relates to a contact material for vacuum interrupter which is splendid in breakdown voltage and has a high interrupting ability.

2. Background Art

Vacuum interrupts are expanding its application range very rapidly because of no need of maintenance, no environmental pollution and splendid interrupting ability, or the like. And accompanying the above, a larger interrupting capacity and higher breakdown voltage are being demanded. On the other hand, for ability of vacuum interrupter, there is a very great element which is determined by contact material in a vacuum container.

Hitherto as contact material of this kind, material constituted by a combination of such metals being splendid in vacuum breakdown voltage as copper-chromium (hereafter is indicated as Cu-Cr. For other elements and alloys consisting of combinations of other elements are similarly indicated by the element symbols) or the like (Cr, Co, etc.) and Cu being splendid in electric conductivity is often used in a large current range or high voltage range because they are splendid in the interrupting ability and the breakdown ability and the like. However, demands for adaptation to larger current and for higher voltage is further severe, and it is difficult to satisfy the demanded ability by the conventional contact materials. Furthermore, for miniaturization of the vacuum interrupters, the conventional contact characteristics can not be sufficient also, and a contact material having more splendid characteristic is becoming demanded.

DISCLOSURE OF THE INVENTION

The present invention constituted a contact material for vacuum interrupter by containing copper and chromium, and as other component(s) one component selected from a group consisting of silicon, titanium, zirconium and aluminum.

According to the present invention, there is an effect that a contact material for vacuum interrupter which is splendid in breakdown voltage ability and high in interrupting ability is obtainable.

THE BEST MODE FOR EMBODYING THE PRESENT INVENTION

Figure 1:
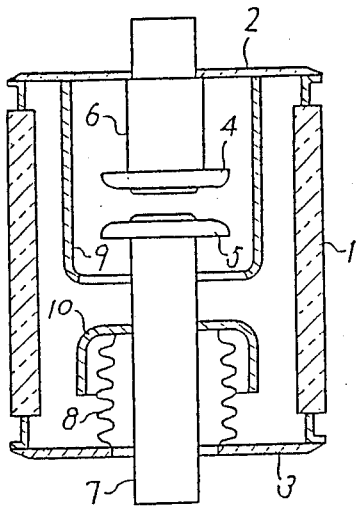
FIG. 1 is a sectional view showing construction of a vacuum switching tube for applying one embodiment of the invention.

Hereafter, one embodiment of the present invention is elucidated with reference to the drawing.

Figure 2:
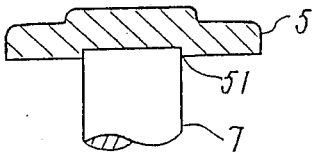
FIG. 2 is an enlarged sectional view of part of an electrode of FIG. 1.

FIG. 1 is a configuration view of a vacuum switch tube, wherein inside of a container formed by a vacuum insulation container (1) and end plates (2) and (3) which close both ends of the above-mentioned vacuum insulation container (1), electrodes (4) and (5) are disposed respectively on contact rods (6) and (7) in a manner to each other face. The above-mentioned electrode (7) is connected to the above-mentioned end plate (3) through a bellows (8) in a manner not to lose airtightness but is movable in an axial direction. Shields (9) and (10) cover the inside face of the above-mentioned vacuum insulation container (1) and the above-mentioned bellows (8), respectively, so as not to be contaminated by a vapor generated by arc. Configurations of the electrodes (4) and (5) are shown in FIG. 2. The electrode (5) is soldered by its back face to the contact rod (7) through a soldering material (51) inserted inbetween. The above-mentioned electrodes (4) and (5) consist of contact material of Cu-Cr-Si, Cu-Cr-Ti, Cu-Cr-Zr or Cu-Cr-Al.

We made various experiments making contact materials for trial wherein into Cu various metals, alloys, intermetallic compounds are added, and assembling it into a vacuum switch tube. As a result of this, it becomes revealed that a very splendid breakdown ability is possessed by a contact material, which contains Cu and Cr and to which one metal selected from Si, Ti, Zr and Al is added, making a distribution in at least one state selected from following four states of a state of simple substance metal, a state of an alloy at least two components selected from Cu, Cr and additives and a state of an intermetallic compound of at least two compounds selected from the above-mentioned three compounds, and a state of a composite of at least two matters selected from these simple substance metal, alloy and intermetallic compound.

Results of making various measurements and tests are described in the following.

Figure 3:
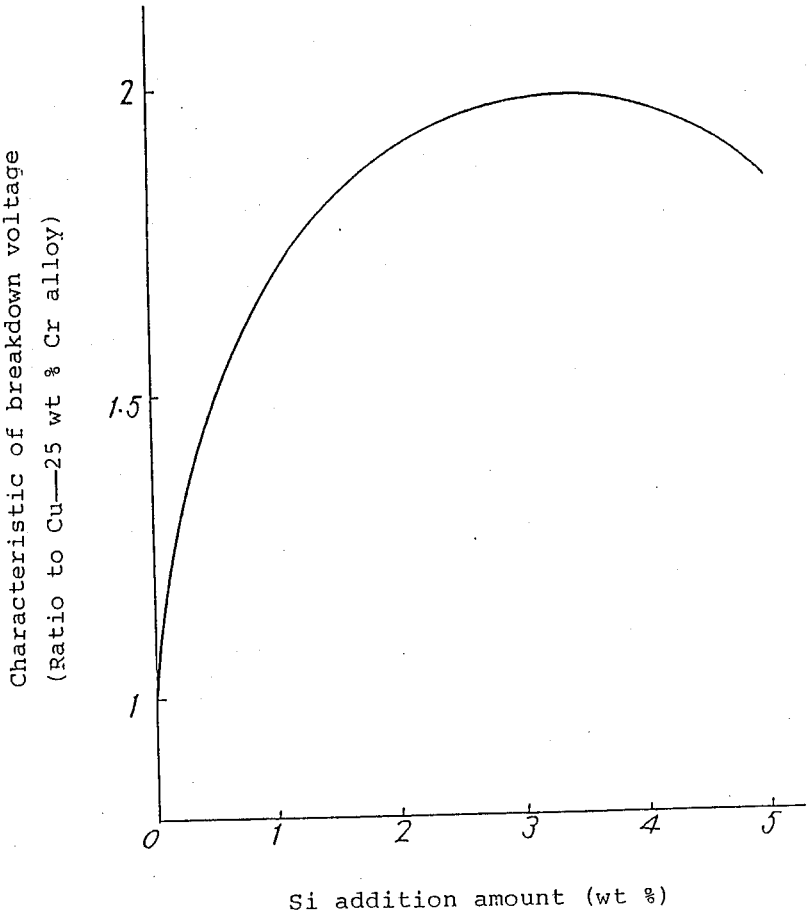
FIG. 3 is a characteristic view showing change of breakdown voltage ability when Si addition amount is changed to an alloy which is a contact material of the present invention wherein Cr amount is fixed at 25 wt %.

FIG. 3 shows relation between Si amount added to an alloy wherein Cr amoutn is fixed to 25 wt % and breakdown voltage ability as a magnitude against the conventional ones' breakdown of which is taken as 1, and it shows that within a range of Si amount of under 5 wt % the breakdown voltage ability drastically increases to as 1.98 times as maximum, in comparison with the conventional one (Cu-25 wt % Cr alloy).

As amount of addition of Si, the breakdown voltage ability shows its peak in a range of 3–4 wt %, and when amount of addition is increased thereover the breakdown voltage ability shows tendency of decrease. That is, Cr and Si coexist in Cu and their mutual function raise the breakdown voltage ability, but when Si is increased above a certain extent, Cu and Si make their compounds or the like in a large amount, and thereby electric conductivity and thermal conductivity of Cu matrix is greatly lowered, thereby becoming likely to discharge thermal electrons. Furthermore, in an alloy comprising Cu and Si, there is a tendency that its melting point is lowered as Si amount increases, and it is considered that by electrification of current very small and local arc-welding is generated and after opening of contacts minute protrusions are produced on the contact surface, forming concentration of electric field at the protrusions and the breakdown voltage ability decreases.

The considered phemomenon becomes prominent as Si amount exceeds 5 wt %; incidentally Si amount of 0.1 wt % or more was effective.

When being used for a large current, considering generation of heat by electrication 3 wt % or below is desirable for Si amount. Incidentally, Cu-Cr-Si alloy used in this experiment was obtained by shape-forming mixed powder made by mixing respective necessary amounts of Cu powder, Cr powder and Si powder, and thereafter sintering it in hydrogen atmosphere.

Ordinate of FIG. 3 shows ratio to breakdown voltage value of the conventional Cu—25 wt % Cr alloy taken as 1, and abscissa shows amount of Si addition.

Figure 4:
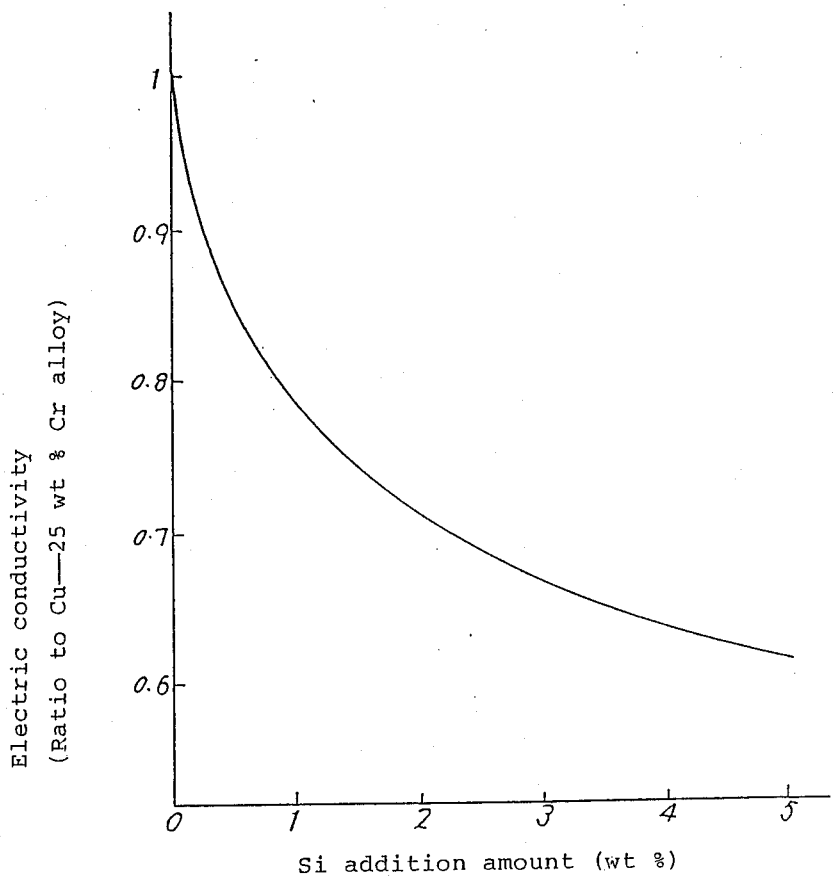
FIG. 4 is a characteristic diagram showing change of electric conductivity when Si addition amount is changed to an alloy which is a contact material of the present invention wherein Cr amount is fixed at 25 wt %.

FIG. 4 similarly shows relation between Si addition amount and electric conductivity. As is obvious from the drawing, it is clear that as Si amount increases the electric conductivity decreases, and so, for using in a vacuum interrupter 5 wt % is limit and for a large electric capacity one 3 wt % or below is desirable.

Figure 5:
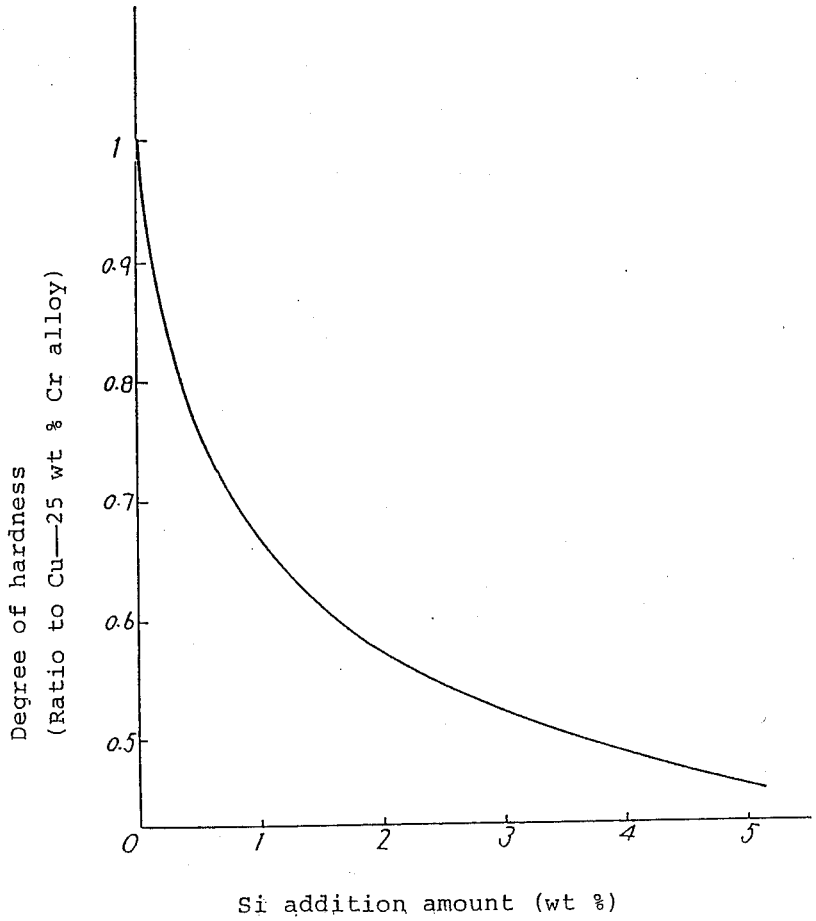
FIG. 5 is a characteristic curve showing change of hardness when Si addition amount is changed to an alloy which is a contact material of the present invention wherein Cr amount is fixed at 25 wt %.

Ordinate of FIG. 5 shows ratio to the conventional one (Cu—25 wt % Cr one) taking electric conductivity thereof as 1.

FIG. 5 similarly shows relation between Si amount and hardness, and as is obvious from the drawing as Si amount increases, the hardness lowers. But, the hardness and the breakdown voltage ability of the present invention has a correlation which is akin to a negative one. This shows that the breakdown voltage ability depends not only on the hardness of the contact alloy bust greatly depends on physical property possessed by the alloy.

The inventors made experiments of relations between Si addition amount and breakdown voltage ability for alloys wherein Cr amount is changed from 5 to 40 wt %, and found that there is a peak of the breakdown voltage ability for Si amount of 5 wt % or below for any cases of Cr amount. Then, from experiments made by fixing Si amount at 3 wt % and changing Cr amount, the following matter became clear. That is, for Cr amount of a range of 35 wt % or below, breakdown voltage ability surpassing the conventional ones (Cu—25 wt % Cr) was obtained; but on the other hand, in case that Cr amount is less than 20 wt % weld-resisting ability was insufficient. Accordingly, for Cr amount, 20–35 wt % range is desirable.

On the other hand, with respect to interrupting ability of the matters of the present invention, difference from the conventional ones (Cu—25 wt % Cr) was hardly observed. Accordingly, it is considered that Si is effective for the breakdown voltage ability.

Figure 6:
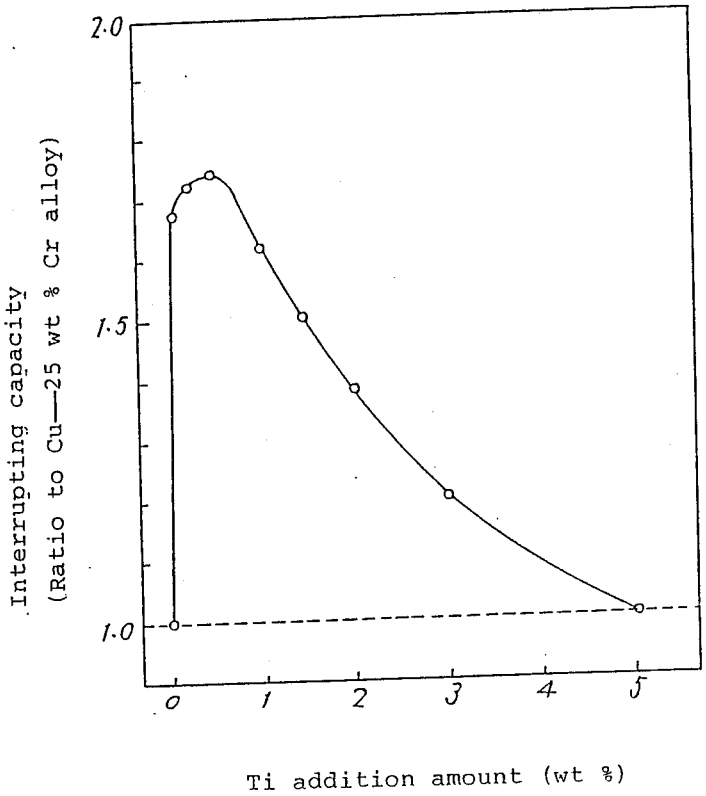
FIG. 6 is a characteristic diagram showing change of interrupting capacity when Ti addition amount is changed to an alloy which is a contact material of the present invention wherein Cr amount is fixed at 25 wt %.

FIG. 6 shows relation between Ti amount added to the alloy wherein Cr amount is fixed at 25 wt % and interrupting capacity, and it is obvious that for a range of Ti amount of 5 wt % or below the interrupting ability is very much raised in comparison with the conventional one (Cu—25 wt % Cr alloy).

With respect to the Ti addition amount, in a range of 1 wt % or below it shows a peak, on the other hand when the addition amount is increased above it a decrease of interrupting capacity takes place. This is because that though coexisting of Cr and Ti in Cu by their mutual action increases the interrupting ability, when the Ti is increased above a certain extent the Cu and Ti produce compound or the like in a large amount, thereby very much decreasing electric conductivity and thermal conductivity of Cu matrix, hence making quick radiation of thermal input by arc difficult and lowering the interruption ability.

When using for a large current, for the Ti addition amount, 1.5 wt % or below wherein the interrupting capacity is above 1.5 times of the Cu—25% Cr alloy is most desirable. Incidentally, the Cu-Cr-Ti alloy used in this experiment is obtained by shape-forming mixed powder made by mixing respective necessary amount of Cu powder, Cr powder and Ti powder, and sintering it.

Ordinate of FIG. 6 shows ratio to the conventional Cu—25 wt % Cr alloy taking the interrupting capacity value as 1, and abscissa shows amount of Ti addition.

Figure 7:
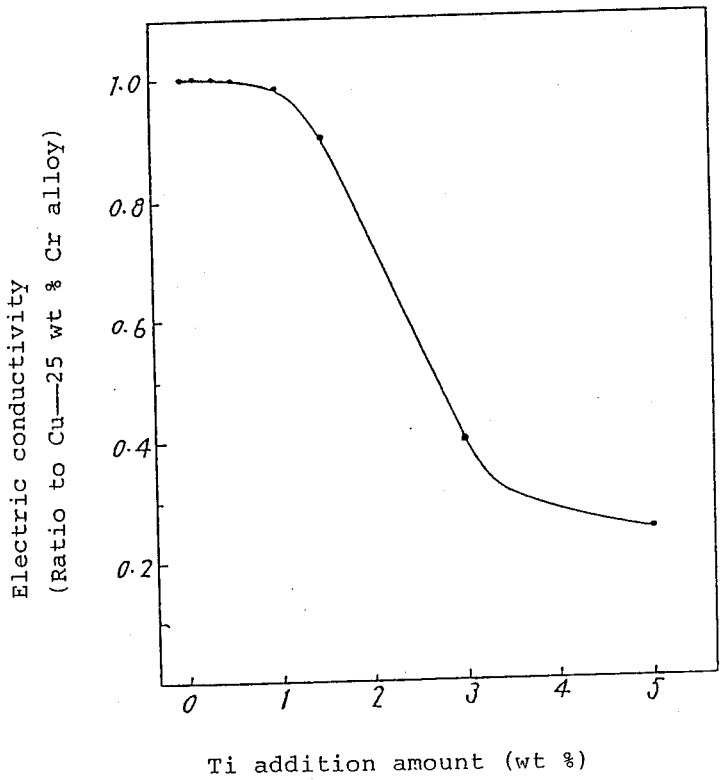
FIG. 7 is a characteristic diagram showing change of electric conductivity when Ti addition amount is changed to an alloy which is a contact material of the present invention wherein Cr amount is fixed at 25 wt %.

FIG. 7 similarly shows a relation between Ti addition amount and electric conductivity. As is obvious from the drawing, when the Ti amount is 1 wt % or below, there is only slight difference from the conventional one (Cu—25 wt % Cr alloy), as the Ti addition amount increases, as electric conductivity start to be lowered, and becomes considerably worse when it exceeds 3 wt %. As the electric conductivity is lowered, contact resistance increases, and when the Ti amount exceeds 3 wt % there may be undesirable influences on electrification during switching on and off as well as after an interruption, and so through the Ti is effective up to 5 wt % or below in view of the interrupting ability, for a uese where contact resistance is important range of Ti of 3 wt % or below is desirable. Ordinate of FIG. 7 shows ratio to the conventional one (Cu—25 wt % Cr alloy) taking electric conductivity thereof as 1.

Figure 8:
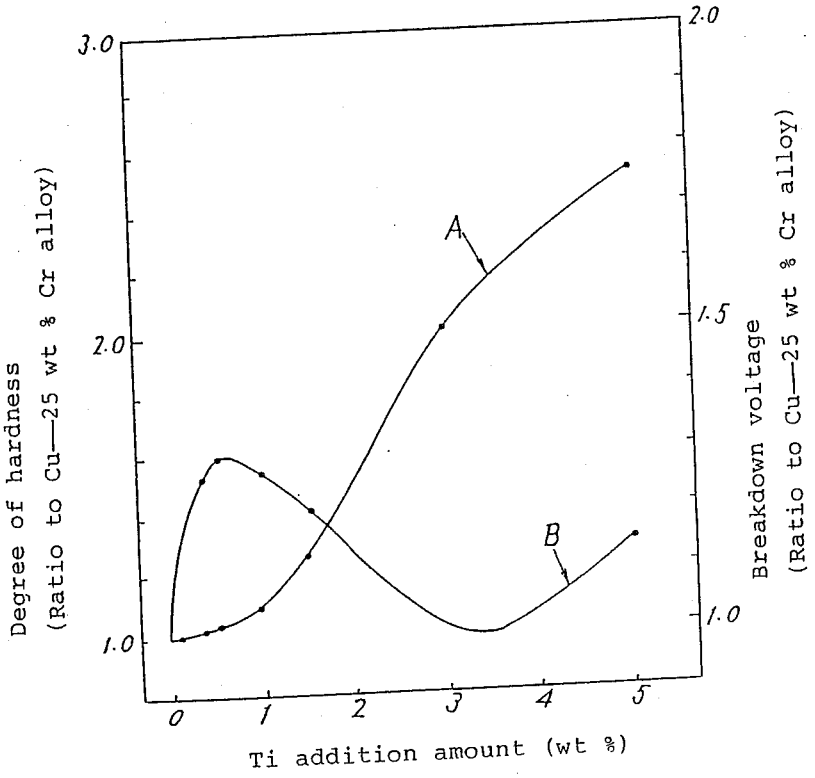
FIG. 8 is a characteristic curve showing changes of hardness (A) and breakdown voltage ability (B) when Ti addition amount is changed to an alloy which is a contact material of the present invention wherein Cr amount is fixed 25 wt %.

FIG. 8 similarly shows a relation of Ti addition amount and hardness (A) and breakdown voltage ability (B). As is obvious from the drawing, for Ti amount of 1 wt % or below there is substantially no increase of hardness, and for 1 wt % or above the hardness gradually increases. This is because for the Ti amount of 1 wt % or above, Cu and Ti react to produce much of intermetallic compound, thereby to increase hardness of Cu matrix. On the other hand, the breakdown voltage has a peak for the Ti amount of about 0.5 wt %, and thereafter lowers until about 3 wt %, and thereafter increases again. Increase of the breakdown voltage ability for Ti amount of 3 wt % or above is considered to be owing to increase of the hardness, but for the Ti amount of 3 wt % or below it is likely to have no direct relation with the increase of hardness. Thus, in view of both the breakdown voltage ability and hardness, by considering workability of material, the Ti amount is preferable to be 3 wt % or below. Ordinate of FIG. 8 shows of a ratio to the conventional one (Cu—25 wt % Cr alloy) taking electric conductivity thereof as 1.

As shown in FIG. 6, the inventors also made experiments of relations between Ti addition amount and interrupting capacity for alloys wherein Cr amount is changed from 5 to 40 wt %, and found that there is a peak of interrupting capacity for Ti amount of about 0.5 wt % for any cases of Cr amount. Then, from experiment by fixing the Ti amount at 0.5 wt % and changing the Cr amount, the following matter became clear. That is, for Cr amount of a range of B 30 wt % or below, the interrupting capacity surpassing the conventional one (Cu—25 wt % Cr alloy) was obtained: but on the other hand in case that Cr amount is less than 20 wt %, the weld-resisting ability and breakdown voltage were insufficient, and is unsuitable as contacts for interrupter. Accordingly, for Cr amount, 20–30 wt % range is desirable.

Figure 9:
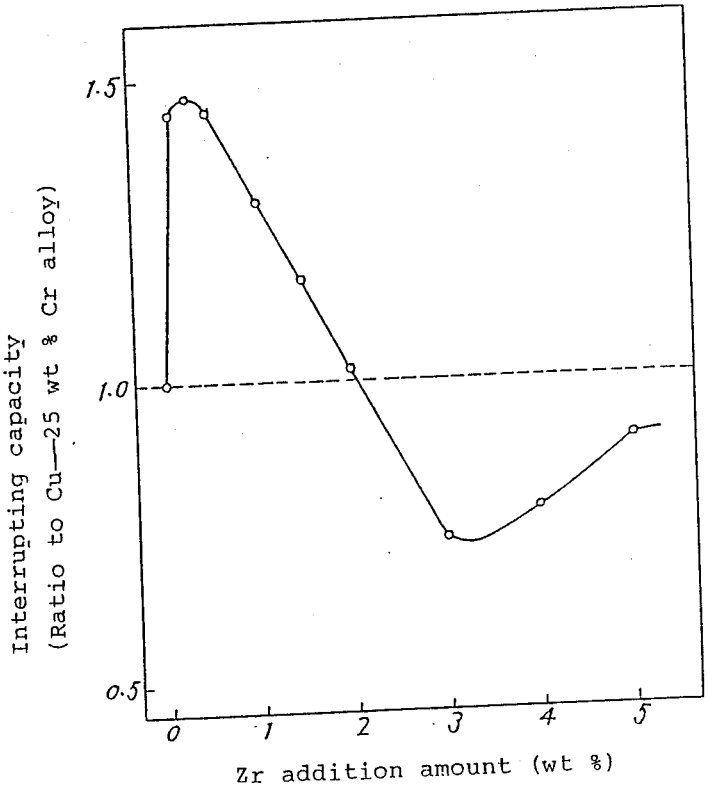
FIG. 9 is a characteristic view showing change of interrupting capacity when Zr addition amount is changed to an alloy which is a contact material of the present invention wherein Cr amount is fixed at 25 wt %.

FIG. 9 shows relation between Zr amount added to the alloy, wherein Cr amount is fixed at 25 wt %, and interrupting capacity, and it is obvious that for a range of Zr amount of 2 wt % or below the interrupting ability is very much raised in comparison with the conventional one (Cu—25 wt % Cr alloy).

With respect to the Zr addition amount, in a range of 0.5 wt % or below it shows a peak, but on the other hand when the addition amount is increased above it a decrease of the interrupting capacity is observed. Further, when the Zr amount exceeds 2 wt %, the interrupting ability is rather lowered than the conventional one (of Cr—25 wt % Cr).

This is because that, by coexistence of Cr and Zr in Cu, and by producing alloys and intermetallic compounds consisting of very small amounts of two or three kinds of Cu, Cr and Zr, to be distributed in Cu, from mutual action thereof an increase of the interrupting ability is observed, but when Zr is increased above a certain extent, particularly Cu and Zr produce compound or the like in large amount, thereby very much lowering electric conductivity and thermal conductivity of Cu matrix, hence making quick radiation of thermal input by arc difficult and lowering the interrupting ability.

In case that using for a large current or miniaturization of equipment is expected, for Zr addition amount, 1.0 wt % or below wherein the interrupting capacity is above 1.3 times of the conventional one (Cu—25 wt % CR alloy) is most desirable, but 2 wt % or below is sufficiently usable. Incidentally, the Cu-Cr-Ti alloy used in this experiment is obtained by mixing respective necessary amount of Cu powder, Cr powder and Zr powder shape-forming the mixed powder and sintering it. Ordinate of FIG. 9 shows the ratio of interrupting capacity to the conventional Cu—25 wt % Cr alloy taken as 1, and abscissa shows amount of Zr addition.

Figure 10:
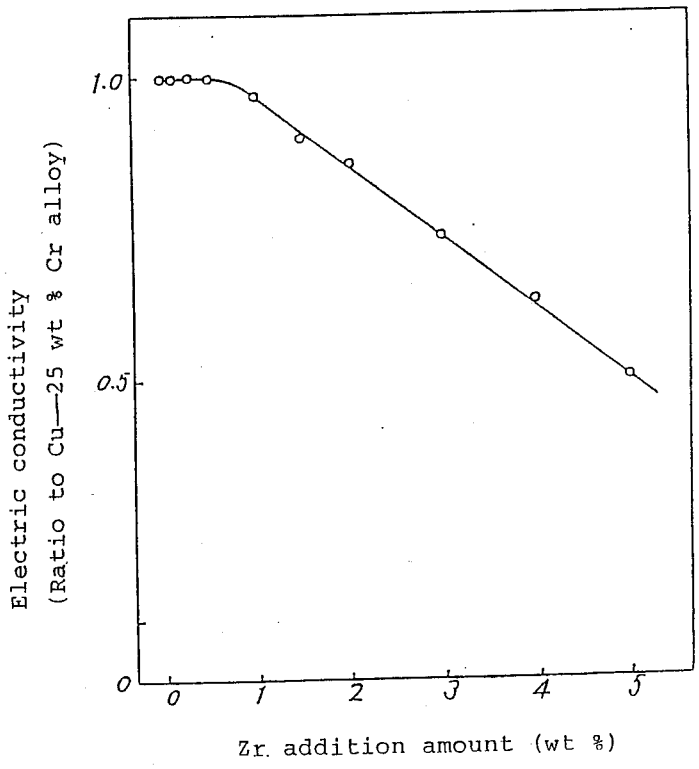
FIG. 10 is a characteristic diagram showing change of electric conductivity when Zr addition amount is changed to an alloy which is a contact material of the present invention wherein Cr amount is fixed at 25 wt %.
Figure 11:
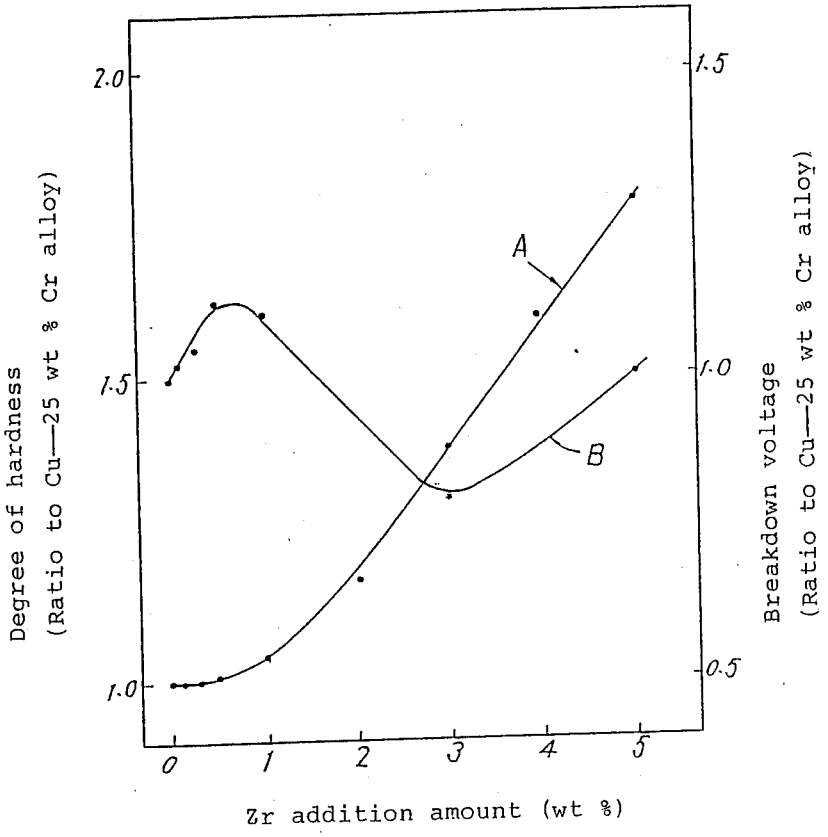
FIG. 11 is a characteristic curve showing changes of hardness (A) and breakdown voltage ability (B) when Zr addition amount is changed to an alloy which is a contact material of the present invention wherein Cr amount is fixed at 25 wt %.

FIG. 10 similarly shows a relation between Zr addition amount and electric conductivity. As is obvious from the graph, when the Zr amount is 2 wt % or below, difference from the conventional one (Cu—25 wt % Cr alloy) is hardly observed, but when the Zr amount is further increased, the Zr amount as well as the electric conductivity begins to decrease, and when Zr amount reaches to 5 wt % they become even to half of the conventional one (Cu—25 wt % Cr alloy). This owes only to an increase of compound produced from Cu and Zr. Though the contact resistance may sometimes increases as the electric conductivity is lowered, and may adversely influenced on switching on and off as well as electrification during after an interrupting, there is no particular problem in a range of the Zr of 2 wt % or below. Ordinate of FIG. 10 shows the ratio to the conventional one (Cu—25 wt % Cr alloy) taking electric conductivity thereof as 1, and abscissa shows Zr addition amount. FIG. 11 similarly shows a relation between Zr addition amount and hardness (A) and breakdown voltage ability (B). As is obvious from the drawing, when the Zr amount is 1 wt % or below, there is substantially no increase of the hardness, and for 1 wt % or above the hardness gradually increases. This is because for the Zr amount of 1 wt % or above, Cu and Zr react to produce the intermetallic compound, thereby to increase the hardness of Cu matrix. On the other hand, the breakdown voltage ability has a peak for the Zr amount of from about 0.5 to 1.0 wt %, and thereafter lowers to about 3 wt %, and thereafter increases again. For the Zr amount of 3 wt % or above increase of the breakdown voltage ability may be considered to be owing to increase of the hardness; but, for the Zr amount of 3 wt % or below, there is no linear relation between the hardness and the breakdown voltage ability. Thus, in view of the hardness and the breakdown voltage ability and the like, also in electrical characteristics and workability of material, the Zr amount is suitable for contact for interrupter to be in a range of 2 wt % or below. Further in view of the workability a range of 1 wt % or below is most desirable. Ordinate of FIG. 11 shows a ratio to the conventional one (Cu—25 wt % Cr alloy) taking the values of hardness and breakdown voltage as 1, and abscissa shows Zr addition amount.

The inventors, as shown in FIG. 9, made experiment of relations between Zr addition amount and interrupting capacity for alloys wherein Cr amount is changed from 5 to 40 wt %, and found that there is a peak of the interrupting capacity for Zr amount about from 0.3 to 0.5 wt % for any cases of Cr amount. Then, as a result of making experiment by fixing the Zr amount at 0.3 wt % and changing the Cr amount, the following matter became clear.

That is, for Cr amount of a range of 30 wt % or below, the interrupting capacity surpassing the conventional one (Cu—25 wt % Cr alloy) was obtained, on the other hand in case that the Cr amount is less than 20 wt % weld-resisting ability and breakdown voltage was insufficient, and unsuitable as the contact material for interrupter. Accordingly, for Cr amount, 20–30 wt % range is preferable.

Figure 12:
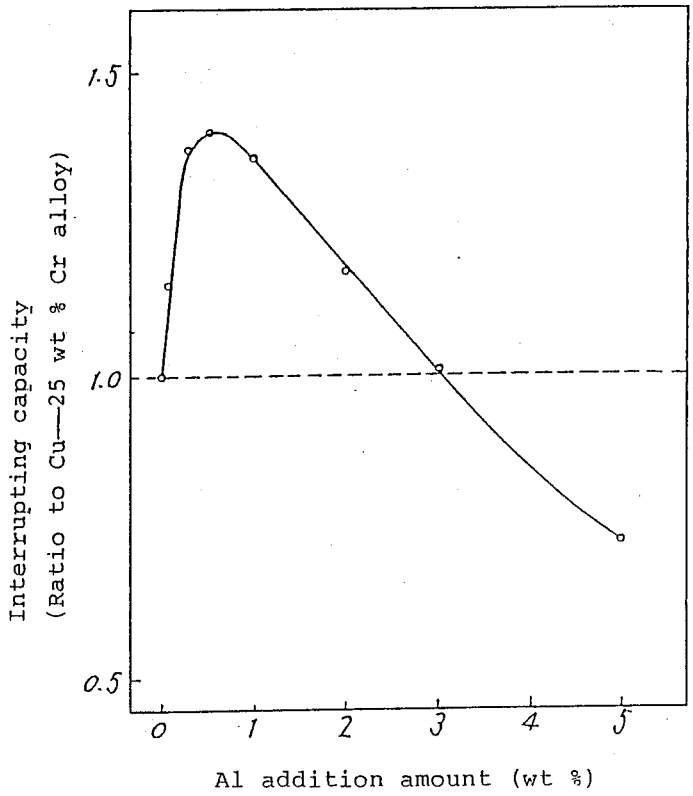
FIGS. 12 and 13 are a characteristic views respectively showing change of interrupting capacity and of electric conductivity when Al addition amount is changed to an alloy which is a contact material of the present invention wherein Cr amount if fixed at 25 wt %.

FIG. 12 shows a relation between Al amount added to the alloy wherein Cr amount is fixed at 25 wt % and interrupting capacity, and it is clear that for a range of the Al amount of 3 wt % or below, the interrupting ability is very much raised in comparison with the conventional one (of Cu—25 wt % Cr alloy).

With respect to the Al addition amount, in a range of 1 wt % or below it shows a peak; on the other hand when the addition amount is increased above it, a decrease of the interrupting capacity is observed. Further when the Al amount exceeds 3 wt % the interrupting ability is rather lowered than the conventional one (Cu—25 wt % Cr alloy).

That is, the reason is supposed that Cr and Al by coexistence of Cu, and by producing alloys and intermetallic compounds consisting of very small amounts of two or three kinds of Cu, Cr, or Al, to be distributed in Cu, from mutual action thereof an increase of the interrupting ability is observed, but when Al is increased above a certain extent, particularly the Cu and Al produce compound or the like in large amount, thereby very much lowering electric conductivity and thermal conductivity of Cu matrix, hence making quick radiation of thermal input by arc difficult and partial melting liable, thereby making arc continue and to lower the interrupting ability.

Figure 13:
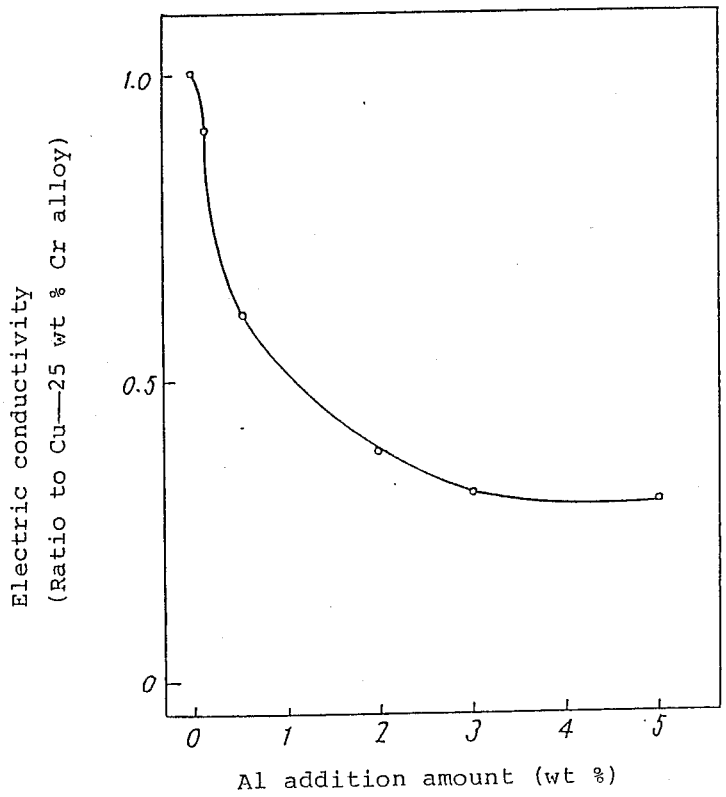

In case that using for a large current or miniaturization of the equipment is expected, for the Al addition amount, 1.3 wt % or below wherein the interrupting capacity is above 1.3 times of the conventional one (Cu—25 wt % Cr alloy) is most desirable, but 3 wt % or below is sufficiently usable. Incidentally the Cu-Cr-Al alloy used in this experiment is obtained by mixing respective necessary amount of Cu powder, Cr powder and Al powder and sintering the same. Ordinate of FIG. 12 shows ratio to the conventional one (of Cu—25 wt % Cr alloy) taking value of the hardness and the breakdown voltage thereof as 1, and abscissa shows Al addition amount. FIG. 13 similarly shows relation between Al addition amount and electric conductivity. As is obvious from the drawing, as the Al amount increase the electric conductivity is lowered, and for Al amount of 1 wt % or above the electric conductivity becomes so far as half of the conventional one. This owes to increase of compound produced from Cu and Al. Also as the electric conductivity is lowered, the contact resistance increases, and sometimes may induce undesirable influences on switching on and off of the load and electrification and temperature rise after an interruption. Accordingly, for Al amount, a range of 1.3 wt % or below is desirable. Ordinate of FIG. 13 shows ratio to the conventional one (of Cu—25 wt % Cr alloy) taking electric conductivity thereof as 1, and abscissa shows Al addition amount.

Figure 14:
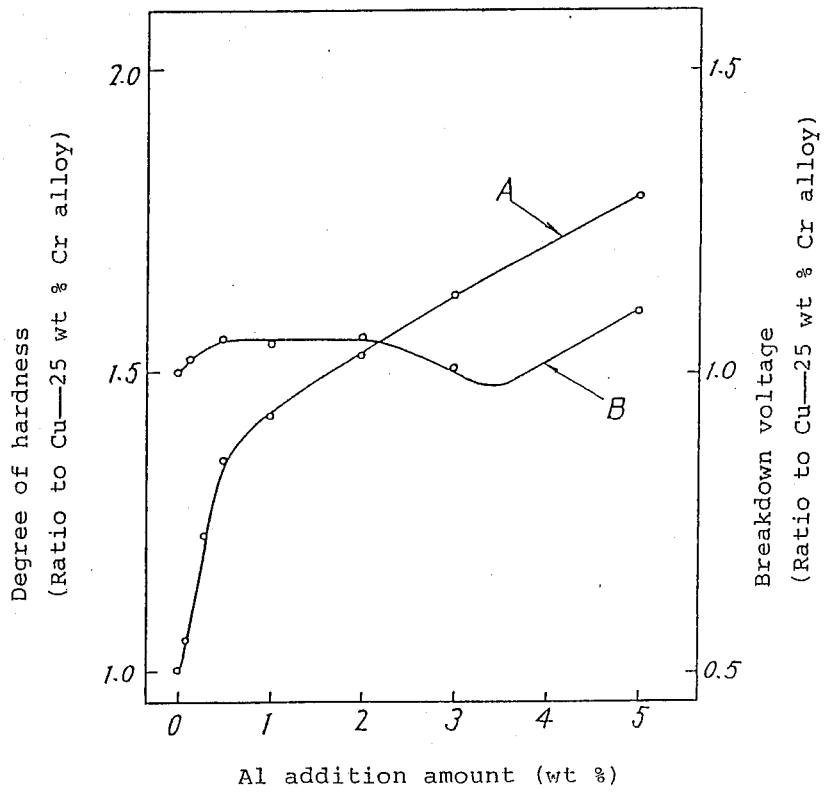
FIG. 14 is a characteristic curve showing changes of hardness (A) and breakdown voltage ability (B) when Al addition amount is changed to an alloy which is a contact material of the present invention wherein Cr amount is fixed at 25 wt %.

FIG. 14 similarly shows relation between hardness (A) and breakdown voltage ability (B). As is obvious from the drawing, until Al amount of 0.5 wt %, fairly rapid increase of hardness is observed, and thereafter the relation between the increase of Al amount and the hardness is linear. This is because that compound produced from Al and Cu consists of intermetallic compound having very much high hardness. On the other hand, the breakdown voltage ability surpasses the conventional one for a range of 3 wt % or below, and in a range above 3 wt % there is a range being inferior to the conventional one. Thereafter as Al amount increases the breakdown voltage also has a tendency of increasing. Thus the relation between the hardness (A) and the breakdown voltage are non-linear in a range of Al amount of 3 wt % or below, and for Al amount of 3 wt or above there may be correlation between the hardness (A) and the breakdown voltage (B). As mentioned above, in view of the hardness (A) and the breakdown voltage ability (B) and the like, also in electrical characteristics and workability of material and the like. Al amount, a range of 3 wt % or below is preferable for contact material for interrupter. Ordinate of FIG. 14 shows a ratio to the conventional one (Cu—25 wt % Cr alloy) taking the hardness (A) and the breakdown voltage (B) thereof as 1, and abscissa shows Al addition amount.

The inventors made experiments, as shown in FIG. 12, on relations between Al addition amount and interrupting capacity for alloys wherein Cr amount is variously changed from 5 to 40 wt %, and found that there is a peak of the interrupting capacity for Al amount of about 0.5 wt % for any cases of Cr amount.

Then by making experiment by fixing the Al amount at 0.5 wt % and changing the Cr amount, the following matter became obvious.

That is, for Cr amount of a range of 30 wt % or below, the interrupting capacity surpassing the conventional one (of Cu—25 wt % Cr alloy) was obtained, and on the other hand in case that Cr amount is less than 20 wt %, weld-resisting ability and breakdown voltage was insufficient, and unsuitable as the contact material for interrupter. Accordingly, for Cr amount, a range of 20–30 wt % is desirable.

Further, though not illustrated by a diagram, in a low chopping current vacuum interrupter wherein, into the above-mentioned contact material, at least one kind selected from following four kinds, at least one low-melting-point metal selected from Bi, Te, Sb, Tl, Pb, Se, Ce and Ca, an alloy comprising at least one component selected from the above-mentioned eight components, an intermetallic compound comprising at least one component selected from these eight components and an oxide comprising at least one component selected from these eight components, is added in a range of 20 wt % or below, similarly to the above-mentioned embodiments, it is confined that there is an effect of raising the interrupting ability and the breakdown voltage ability.

Incidentally, in case that at least one kind selected from these low melting point metals, alloys and intermetallic compound is added in a range of 20 wt % or below, interrupting ability is remarkably lowered.

Further, in case that the low melting point metals are Ce, Ca, characteristics are lowered to some extent in comparison with case of another component.

We claim:

1. A contact material for a vacuum interrupter containing copper as a basic component, and, as another component, from approximately 20 to 35% by weight of chromium, and further containing an amount of silicon about 5% by weight or below.

2. A contact material for a vacuum interrupter in accordance with claim 1 wherein copper, chromium and silicon are distributed therein as a single metal, as a ternary alloy of these metals, as a binary alloy of these metals, as a ternary intermetallic compound of these metals, as a binary intermetallic compound of these metals, or as combinations thereof.

3. A contact material for a vacuum interrupter in accordance with claim 2 further containing no more than 20% by weight of at least one of the following:

at least one low-melting-point metal selected from the group consisting of bismuth, tellurium, antimony, thallium, lead, selenium, cerium and calcium, at least one alloy of said low-melting-point metals, an intermetallic compound comprising at least one of said low-melting-point metals, or at least one oxide comprising at least one of said low-melting-point metals.

4. A contact material for a vacuum interrupter containing copper as a basic component, and, as another component, from about 20 to 30% by weight of chromium, and further containing an amount of aluminum approximately 3% by weight or below.

5. A contact material for a vacuum interrupter in accordance with claim 4 wherein copper, chromium and aluminum are distributed therein as a single metal, as a ternary alloy of these metals, as a binary alloy of these metals, as a ternary intermetallic compound of these metals, as a binary intermetallic compound of these metals, or as combinations thereof.

6. A contact material for a vacuum interrupter in accordance with claim 5 further containing no more than 20% by weight of at least one of the following:

at least one low-melting-pont metal selected from the group consisting of bismuth, tellurium, antimony, thallium, lead, selenium, cerium and calcium, at least one alloy of said low-melting-point metals, an intermetallic compound comprising at least one of said low-melting-point metals, or at least one oxide comprising at least one of said low-melting-point metals.

* * * * *